United States Patent [19]

Wolff

[11] Patent Number: 4,563,270

[45] Date of Patent: Jan. 7, 1986

[54] SELF CLEANING, PERFORATED PLATE FOR OSCILLATING SIEVE

[76] Inventor: Kurt Wolff, Flurstrasse 42, Dinslaken, Fed. Rep. of Germany

[21] Appl. No.: 314,095

[22] PCT Filed: Dec. 1, 1980

[86] PCT No.: PCT/EP80/00141

§ 371 Date: Dec. 4, 1981

§ 102(e) Date: Dec. 4, 1981

[87] PCT Pub. No.: WO81/02398

PCT Pub. Date: Sep. 3, 1981

[30] Foreign Application Priority Data

Feb. 20, 1980 [DE] Fed. Rep. of Germany ..... 3006364

[51] Int. Cl.[4] ..... B07B 1/46

[52] U.S. Cl. ..... 209/379; 209/397

[58] Field of Search ..... 209/400, 405, 408, 379, 209/392–399; 210/498, 499

[56] References Cited

U.S. PATENT DOCUMENTS

| | | | |
|---|---|---|---|
| 2,870,910 | 1/1959 | Wehner | 209/396 |
| 3,194,397 | 7/1965 | Taege | 209/394 |
| 4,120,785 | 10/1978 | Kandmori et al. | 209/401 |
| 4,222,865 | 9/1980 | Valeri | 209/399 |
| 4,347,129 | 8/1982 | Rutherford | 209/408 |

FOREIGN PATENT DOCUMENTS

| | | | |
|---|---|---|---|
| 965546 | 12/1956 | Fed. Rep. of Germany . | |
| 2102617 | 7/1971 | Fed. Rep. of Germany . | |
| 2108854 | 8/1972 | Fed. Rep. of Germany | 209/397 |
| 2258123 | 5/1974 | Fed. Rep. of Germany | 209/395 |
| 2701307 | 5/1978 | Fed. Rep. of Germany | 209/397 |
| 53-32467 | 3/1978 | Japan | 209/393 |
| 7607964 | 7/1975 | Netherlands | 209/397 |
| 425877 | 3/1935 | United Kingdom | 209/393 |
| 883176 | 11/1961 | United Kingdom . | |
| 1024290 | 2/1964 | United Kingdom . | |

OTHER PUBLICATIONS

"Screen Panels and Their Use" Aufbereitungstecknik, Year 1, (1960), Issue 11, pp. 457–473 and Issue 12 pp. 501–508.

*Primary Examiner*—Frank W. Lutter
*Assistant Examiner*—Wm. Bond
*Attorney, Agent, or Firm*—Pollock, Vande Sande and Priddy

[57] ABSTRACT

A screen panel for vibratory screening machines can consist of at least one cast, injection-molded or vulcanized perforated plate of elastically flexible material, such as plastic or rubber. It has a multitude of screen openings (5) and crosspieces (2, 3, 4) surrounding them which are interconnected forming one piece and thus the perforated plate. A self-cleaning effect can be achieved with such a perforated plate in the area of each individual screen opening (5) by means of a relative movement of the edges of the screen openings in order to extend the self-cleaning effect to as large an area as possible of each individual screen opening (5). For this purpose, at least two of the crosspieces (2–4) surrounding the individual screen openings (5) have a differing bending resistance by means of differing cross-sections and/or reinforcements (8).

7 Claims, 4 Drawing Figures

FIG. 1
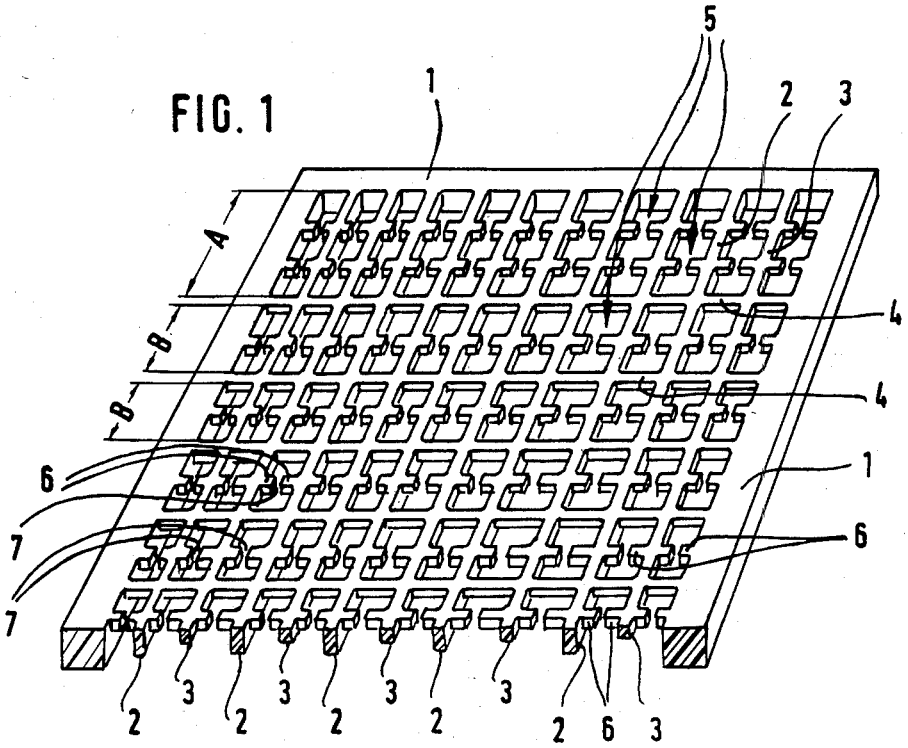
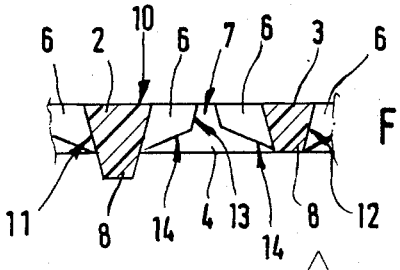
FIG. 4
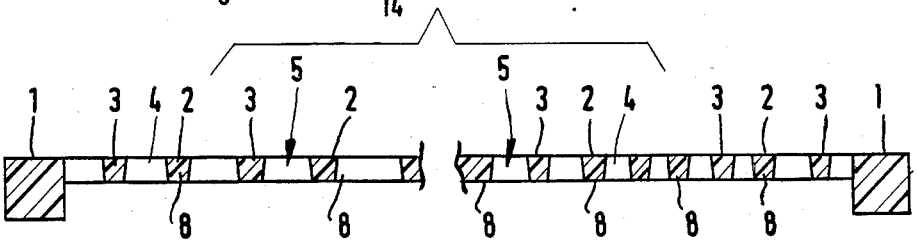
FIG. 2
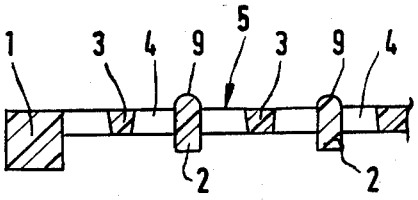
FIG. 3

SELF CLEANING, PERFORATED PLATE FOR OSCILLATING SIEVE

BACKGROUND OF THE INVENTION

The invention refers to a screen panel for a vibratory screening machine.

Such a screen panel consists of at least one cast, injection-molded or vulcanized perforated panel of elastically flexible material, such as plastic or rubber, with a multitude of screen openings and crosspieces surrounding them which are connected with each other as one piece and form perforated panels.

Such screen panels are predominantly used for the classification of bulk materials. In order to avoid an obstruction of the screen openings, particularly by means of near-size material, it is known to take measures towards a self-cleaning effect for such screen panels. As a rule, the screen openings are designed with a conic expansion in the direction of the flow of the material to be screened so that wedged-in near-size material can be moved by being carried along by the material to be screened in its direction of flow. However, there exists also bulk material due to which the screen openings get choked up with mud and, in this instance, the individual particles depositing in the screen openings are by far smaller than the respective near-size material which makes the conicity of the screen openings ineffective against the choking-up with mud.

A known screen panel of the kind mentioned in the introduction is described in the German Disclosure Publication No. 27 01 307. In this instance, the self-cleaning effect is improved by the fact that elastic tongues are formed in the individual screen openings capable of their own vibration. Two screen holes are always connected with each other by a slot in this case and the strip formed in this way, which is only rigidly connected with the crosspieces on one end, has a higher elasticity in comparison with the edges of the screen openings and carries out relative movements. However, the self-cleaning effect caused in this fashion is essentially limited to the area of the freely vibrating ends of the tongues since, towards the connecting point with the crosspieces, the relative movement of the tongues is more and more reduced towards the edges of the screen openings.

A known screen panel is also described in the German Pat. No. 965,546. In this case, the screen panel consists of elastic, strip-shaped elements which have also strip-shaped tongues attached laterally in transverse direction which extend in a determined arrangement to the adjacent strip-shaped element and surround the screen openings. These tongues have no connection with the respective adjacent crosspieces and, therefore, can effect their own vibration and thus a relative movement at least in the area of their free ends towards the continuous crosspieces whereby a self-cleaning effect is obtained which is essentially limited to the area of the ends of the tongues in this case as well. Owing to the relative movements of the vibrating strips in comparison with the crosspieces to which they are attached, special difficulties are encountered, on the one hand, with regard to durability and, on the other hand, with respect to the trueness of the holes of the screen openings. For this reason, the tongues, being additionally capable of vibrating, are, at least partially, provided with a reinforcement and, furthermore, project downward beyond the actual sectional height in order to achieve a sufficient trueness of the mesh or hole with the larger movement in comparison with the more rigid crosspieces.

Wire screen panels have already been known for a long time in which the individual screen openings are surrounded by screen wires which consist of steel. In this case, relative movements of the individual screen wires are produced by means of a differing configuration of the screen wires next to each other or by means of differing wire thicknesses which cause a cleaning effect. The individual screen wires of differing bending resistance must be adjusted to each other in a special manner and fastened to a joint support frame. Even though such wire screen panels have been in use for already more than twenty years, they have not represented a suggestion so far towards the improvement of the self-cleaning effect also of screen panels of the kind mentioned in the introduction with perforated panels of elastically flexible material. (Obering. Kurt Wolff: "Screen panels and their use" in "Aufbereitungstechnik", Year 1 (1960), Issue 11, Pages 457–473 and Issue 12, Pages 501–508).

SUMMARY OF THE INVENTION

Proceeding from a screen panel of the above described kind, the invention is now based on the task of achieving the self-cleaning effect in the area of each individual screen opening by means of a relative movement of the edges of the screen openings in order to expand thus the self-cleaning effect to as large an area as possible of each individual screen opening. This task is accomplished in the case of a screen panel of the mentioned kind by the fact that at least two of the crosspieces surrounding each of the individual screen openings have differing bending resistances as a result of their differing cross-sections and/or reinforcements.

The special advantage of a screen panel according to the invention lies in the fact that the continuous crosspieces of the perforated panel deform towards each other during operation whereby the individual screen openings can be distorted within determinable limits. The change in shape covers then the entire area of each screen opening, particularly then when the crosspieces of differing bending resistance are located at opposite sides of the screen openings. In order to be able to utilize the advantages of the relative movement of the crosspieces of differing bending resistance not only for slot-shaped screen openings but also for rectangular, square or round screen openings, it is advantageous to limit the screen openings by means of extensions attached to the crosspieces whereby these extensions follow the relative movement of the crosspieces with which they are connected. Additionally, these extensions can perform a vibration of their own in order to increase the cleaning effect.

The differing bending resistance of the two crosspieces assigned to each screen opening can be produced, as far as the difference in cross-section in concerned, by means of a difference in the cross-sectional shape as well as by means of a difference in the cross-sectional size. Additionally, the differing bending resistance of the two crosspieces can also be influenced by providing armoring or a reinforcement. However, in principle, the differing cross-sectional shapes and sizes are not required when these crosspieces are provided with a reinforcement. This reinforcement of the crosspieces of differing bending resistance can be different but, in a preferred design, one crosspiece will be alternately used with reinforcement and one without.

A parallel arrangement of the crosspieces of differing bending resistance is expedient. In this way, it is possible to form regularly arranged, equally large screen openings, particularly screen slots. The parallel arrangement of these crosspieces has the effect that the individual screen openings have a different vibration behavior on their edges which are located opposite each other. This is independent of how the screen openings are designed or formed in an overall manner which is especially advantageous when—as already mentioned—the screen openings are also delineated by the extensions attached in cross direction to the crosspieces. The screen openings are, furthermore, delineated by means of crosspieces on the edges or by means of crosspieces intersecting the crosspieces of differing bending resistance; these last mentioned crosspieces produce the interconnection of the screen panel. All crosspieces are connected with each other, forming one piece, owing to the cast, injection-molded or vulcanized design of the perforated plate.

In the case of a perforated plate which is supported all around, a greater vibrational amplitude develops towards the center of the perforated plate than at the supported edges owing to the diaphragm action. In order to achieve a sufficient self-cleaning effect in this instance at the edges as well, it is advantageous to design the interconnections of the parallel and crossing crosspieces less rigidly by increasing the distance either of the parallel and crossing crosspieces or only of the crossing crosspiece towards the edges of the plate. In this fashion, a greater vibrational amplitude is obtained also in the area of the edges.

The vibrational behavior and/or the wear of the crosspieces of differing bending resistance can also be influenced by varying the level with which they project above the upper side of the perforated plate. On the one hand, the more flexible crosspieces may have an upward projection whereby the material to be screened which falls on the projecting crosspieces increases their vibrations and thus the self-cleaning effect. On the other hand, the more rigid crosspieces may also project upward beyond the upper side of the perforated plate. This measure is taken in order to carry the coarser material to be screened with the projection of the more rigid crosspieces; in this manner, the more elastic areas are relieved of the load and are not so much endangered by wear.

In addition to the self-cleaning effect achieved by the differing bending resistance of the crosspieces, the conic expansion of the screen openings in the direction of the flow can also be provided for a screen panel according to the invention in order to obtain a release of near-size particles in the customary manner.

BRIEF DESCRIPTION OF THE DRAWING

The invention is still further explained by means of exemplified embodiments on the basis of the drawing. There are shown:

FIG. 1 a perspective, sectional top view of a perforated plate for a screen panel according to the invention;

FIG. 2 a cross-section through another design of a perforated plate for a screen panel according to the invention;

FIG. 3 a partial cross-section through another design of a perforated plate for a screen panel according to the invention;

FIG. 4 a partial cross-section in an enlarged representation through a fourth design of a perforated plate for a screen panel according to the invention.

DESCRIPTION OF THE PREFERRED EMBODIMENTS

FIG. 1 shows the basic structure of a perforated plate for a screen panel which is intended for use in vibratory screens for the classification of bulk material. The perforated plate consists of an elastically flexible material, such as plastic or rubber. It is cast, injection-molded or vulcanized in one piece using this material.

The perforated plate has boundary members 1 along the edges thereof between which longitudinal crosspieces 1 and 3 and transversely arranged crosspieces 4 extend. These crosspieces are hereinafter called longitudinal crosspieces and transverse crosspieces although they can run, in principle, also diagonally towards each other as well as towards the boundary members 1 along the edges. Also, the design and function of the longitudinal and transverse crosspieces can be interchanged which may apply to the entire perforated plate as well as to partial areas thereof.

The boundary members along the edges serve to support or secure the perforated plate and have a larger cross-section in comparison with the longitudinal crosspieces 2 and 3 as well as the transverse crosspieces 4. Furthermore, the cross-sections or the longitudinal crosspieces 2 and of the longitudinal crosspieces 3 differ as well. The cross-sectional shapes of the longitudinal crosspieces 2 and of the longitudinal crosspieces 3 are actually identical to one another since the longitudinal crosspieces 2 and the longitudinal crosspieces 3 have square or rectangular cross-sections but there is a difference in the size of the cross-sections of the crosspieces 2 and 3. The longitudinal crosspieces 2 have a larger cross-section than the longitudinal crosspieces 3 and have, therefore, a higher bending resistance than the longitudinal crosspieces 3 because of their larger cross-section since the perforated plate, being produced of the same material, is of one piece. For this reason, they have a different vibrational behavior than the more elastic longitudinal crosspieces 3 so that the longitudinal crosspieces 2 perform a relative movement towards the longitudinal crosspieces 3 during operation.

Since the longitudinal crosspieces 2 and 3 enclose, between themselves, screen openings 5 located in a row one behind the other, i.e. delineate these screen openings 5 on opposite sides, the basic shape of the screen openings 5 is deformed during operation owing to the relative movement between the crosspieces 2 and 3. The screen openings 5 can be designed as continuous oblong slots between the transverse crosspieces 4 but the transverse crosspieces 4 can also be entirely eliminated so that the slot-shaped screen openings 5 extend only between the opposite boundary members 1 along the edges of the perforated plate. The number of the transverse crosspieces 4 which support the interconnection of the perforated plate depends of course also on the size of the perforated plate. However, it is largely independent of the length of the screen openings because the screen openings 5 can also be defined by tongues or extensions 6 on the longitudinal crosspieces 2 and 3. In the exemplified embodiment, two such tongues or crosspiece extensions 6 are attached to different crosspieces 2, 3 and are always opposite each other, but a staggered arrangement of the extensions 6 on the crosspieces 2, 3 is also possible. A slot 7 is left between the opposite end faces of the crosspiece extensions 6 so that the crosspiece extensions 6 which are connected with crosspieces having a different vibrational behavior, can move more freely relative to each other. Such a slot 7 at the forward end face of the respective crosspiece extensions 6 is also then to be provided when the crosspiece extension 6 extends to the respective opposite longitudinal crosspiece. The crosspiece extensions 6 make it possible to divide each opening between the crosspieces 2, 3 of differing bending resistance in such a way that screen openings 5 of any configuration can be formed.

As can also be noticed from FIG. 1, the distance "A" of the transverse crosspiece 4 adjacent to the crosspiece 1 at the edge is larger than the distance "B" between the transverse crosspieces 4 themselves. This greater support distance "A" ensures a higher elasticity of the interconnection consisting of the crosspieces 2, 3 and 4 in the area towards that crosspiece 1 at the edge in which the crosspieces 2 and 3 of differing bending resistance end. Since the entire perforated plate vibrates during operation like a diaphragm and, therefore, the longitudinal crosspieces 2 and 3 of a differing bending resistance perform the greatest vibrational amplitude, the area close to the boundary members 1 at the edges is at a disadvantage with its smaller vibrational amplitude for which a compensation can be obtained by the greater elasticity in this area at the edges. So as to produce the same effect also in the area at the edges towards those crosspieces 1 at the edges which are in parallel to the longitudinal crosspieces 2 and 3, the distances of these longitudinal crosspieces 2 and 3 can also be enlarged towards the respective members 1 along the edges.

Independently of this fact, the crosspieces 2 of a greater bending resistance must always be arranged in an alternating manner with the crosspieces 3 of a lesser bending resistance so that, looked at in the direction of the transverse crosspieces 4, a more resistant longitudinal crosspiece 2 is always followed by a more elastic longiutdinal crosspiece 3 and this again by a more resistance longitudinal crosspiece 2.

FIG. 2 shows a perforated plate design in which the differing bending resistance of the longitudinal crosspieces 2 and 3 is not caused by different cross-sectional shapes or sizes but by a reinforcement 8. In this instance, the longitudinal crosspieces 2 and 3 have identical cross-sections and the reinforcement 8 is only embedded in every second longitudinal crosspiece 2 looked at in transverse direction while the respective longitudinal crosspieces 3 located in between them have no reinforcement.

FIG. 3 shows the exemplified embodiment of a perforated plate in which the more resistant longitudinal crosspieces 2 have attached extensions 9 projecting above the upper face 10 of the screen which have the task of supporting coarser material to be screened in order to relieve the more elastic longitudinal crosspieces 3 and transverse crosspieces 4 of high wear. The vibrational behavior can also be influenced by the projecting extensions 9 but it would then be advantageous to provide the projecting extensions 9 on the more elastic longitudinal crosspieces 3.

FIG. 4 illustrates, on the one hand, the possibility of providing the more resistant longitudinal crosspieces 2 with a stronger reinforcement and the more elastic longitudinal crosspieces 3 with a more easily bendable reinforcement 8 in comparison with the reinforcement of the more resistant longitudinal crosspieces 2. Therefore, the differing bending resistance is produced in this design by the cross-sectional sizes of the longitudinal crosspieces 2 and 3 as well as by the different reinforcement 8. It is expedient to arrange the reinforcement 8 in the area of the lower third of the cross-section of the longitudinal crosspieces 2 and 3.

Furthermore, one can notice in FIG. 4 particularly clearly the wedge-shaped design of the longitudinal crosspieces 2 and 3 which is also provided for the transverse crosspieces 4 so that the screen openings 5 get wider in the direction of the flow. This is achieved for the more resistant longitudinal crosspieces 2 as well as for the more elastic longitudinal crosspieces 3 and for the transverse crosspieces 4 by means of lateral delineating surfaces 11 and 12 of the crosspieces 2–4 which converge in the direction of the flow; however, this cannot be noticed in detail from FIG. 4.

FIG. 4 shows still another feature of the crosspiece extensions 6 on the longitudinal crosspieces 2 and 3. The extensions 6, opposite each other, have end faces 13 diverging in the direction of the flow so that the slot 7 located between them also expands in the direction of the flow of the material to be screened. A corresponding inclination of the end faces 13 of the crosspiece extensions 6 is also then to be provided when the crosspiece extensions 6 of the one crosspiece 2, 3 extend to the respective other crosspiece 2, 3; the conicity of the slot 7 is then formed, on the one hand, by the oblique face 13 of the respective crosspiece extension 6 and, on the other hand, by the obliquely arranged lateral face 11, 12 of the pertinent crosspiece 2, 3.

As is additionally illustrated in FIG. 4, the crosspiece extensions 6 can also be tapered towards their free ends, i.e. towards the end face 13. This is expediently achieved by lower faces 14 of the crosspiece extensions 6 running in an inclined manner to the upper face 10 of the screen. The lower faces 14 of the crosspiece extensions 6 can also be designed in a curved fashion and the end faces 13 of the crosspiece extensions 6 can make a continuous transition into the lower faces 14 of these crosspiece extensions 6.

I claim:

1. A screen panel for use in a vibrating screening machine comprising a one piece element which includes a boundary member defining the outer periphery of said panel, a first plurality of spaced crosspiece members disposed in parallel relation to one another and extending between portions of said boundary member, a second plurality of spaced crosspiece members disposed in parallel relation to one another and to said first plurality of spaced crosspiece members between portions of said boundary member, the crosspiece members in said first and second pluralities being disposed in alternating relation to one another whereby a crosspiece member in said first plurality is disposed between a pair of crosspiece members in said second plurality and vice versa, a third plurality of spaced crosspiece members disposed in parallel relation to one another and extending transversely to said first and second pluralities of spaced crosspiece members between other portions of said boundary member, said boundary member and said first, second and third pluralities of crosspiece members being integral with one another and being fabricated of the same material respectively in said one piece element, said boundary member and said transversely disposed crosspiece members defining therebetween a plurality of screen openings, said boundary member being constructed to exhibit a bending resistance that is different from the bending resistances of said first, second and third pluralities of crosspiece members, said first plurality of crosspiece members being constructed to exhibit bending resistances that differ from the bending resistances of said second plurality of crosspiece members whereby two opposite sides of each of said screen openings in said screen panel are defined respectively by a pair of members whose bending resistances differ from one another, and a plurality of tongues integral with and extending outwardly from said boundary member and from said first and second pluralities of crosspiece members, said tongues being spaced from and extending in directions parallel to said third plurality of spaced crosspiece members, at least two of said tongues being located in each of said screen openings and extending respectively toward one another from said boundary members and said first and second crosspiece members, the said two tongues in each of said screen openings having free ends which are spaced from one another to define a slot therebetween.

2. The screen panel of claim 1 wherein said first and second crosspiece members respectively have cross-sectional shapes that differ from one another.

3. The screen panel of claim 1 wherein the cross section of said boundary member is larger than that of the crosspiece members in each of said first, second and third pluralities of crosspiece members.

4. The screen panel of claim 1 wherein the crosspiece members in said first plurality of crosspiece members are provided with reinforcement means operative to give said first crosspiece members a bending resistance that differs from the bending resistance of the said second crosspiece members.

5. The screen panel of claim 1 wherein said boundary member is rectangular in configuration, said first and second pluralities of crosspiece members being disposed substantially parallel to two opposite sides of said rectangular configuration, said third plurality of crosspiece members being disposed substantially parallel to the other two opposite sides of said rectangular configuration, the distance between said other two opposite sides and the closest ones of said third plurality of crosspiece members being greater than the distance between each pair of said second plurality of crosspiece members.

6. The screen panel of claim 1 wherein said slot varies in width in a direction transverse to the plane of said screen panel.

7. The screen panel of claim 1 wherein said at least two tongues are tapered in a direction toward their respective free ends.

* * * * *